United States Patent [19]

Murphy

[11] Patent Number: 4,598,295

[45] Date of Patent: Jul. 1, 1986

[54] REPLACEABLE RADIO ANTENNA

[75] Inventor: Harold R. Murphy, Herkimer, N.Y.

[73] Assignee: General Electric Company, Portsmouth, Va.

[21] Appl. No.: 648,648

[22] Filed: Sep. 7, 1984

[51] Int. Cl.[4] ..... H01Q 1/24

[52] U.S. Cl. ..... 343/702; 343/901

[58] Field of Search ..... 343/702, 900, 901, 905, 343/906

[56] References Cited

U.S. PATENT DOCUMENTS

| | | | |
|---|---|---|---|
| 2,161,777 | 6/1939 | Sarnes | 343/900 |
| 2,471,020 | 5/1949 | Benton | 343/900 |
| 2,735,932 | 2/1956 | Textrom et al. | 343/702 |
| 3,987,448 | 10/1976 | Scheppman | 343/702 |

*Primary Examiner*—Eli Lieberman

[57] ABSTRACT

A portable radio is provided with a whip antenna that can be removed and replaced without requiring the disassembly of the radio. The antenna is removed and replaced through an opening in the radio housing, and it is secured in its assembled position by a fastener extending through another opening in the housing.

10 Claims, 6 Drawing Figures

REPLACEABLE RADIO ANTENNA

BACKGROUND OF THE INVENTION

1. Field of the Invention

This invention relates to a removable antenna for radio products such as portable radios and, more particularly, to an antenna assembly which permits a whip antenna to be readily removed and replaced without requiring the disassembly and subsequent reassembly of radio.

2. Description of the Prior Art

Radios must be provided with suitable antennas in order to receive signals transmitted over the air. In the case of AM/FM portable radios, a telescopic whip antenna is generally provided for the receipt of FM signals. The base portion of the antenna is securely mounted in the radio housing, and the telescopic portion is accessible from the exterior of the housing for extension when the receipt of signals is desired and retraction when the FM band is not being used. The lightweight whip antennas used on such products may be relatively easily damaged when in their extended condition. For example, a thin telescopic antenna may be easily bent as a result of misuse or accident. As a result, it often becomes necessary to replace a damaged antenna.

An antenna must be electrically connected to the receiving circuitry of the radio in order to transmit the received signal to the receiving circuitry. In consumer radios, such as portable radios having whip antennas for FM reception, the base portion of the antenna is permanently connected to the radio circuitry when the radio is assembled at the factory. If it subsequently becomes necessary to replace the antenna, the radio must be at least partially disassembled in order to gain access to the electrical connection between the antenna and the receiving circuitry. After the electrical connection is disconnected, the antenna is replaced, and the electrical connection is reconnected, the radio must be reassembled. If the person replacing the antenna is not a skilled technician, there is a risk that delicate internal portions of the radio will be damaged during the antenna replacement procedure. For this reason, it is normally desirable that antennas not be replaced by the consumer, but by trained personnel at either the factory or a service facility. This situation is not totally acceptable for several reasons, including the inconvenience caused to the consumer and the high labor and shipping costs incurred relative to the overall value of the radio. In fact, the costs associated with the replacement of an antenna may exceed the total value of some portable radios, thus making repair impractical and leading to consumer dissatisfaction.

SUMMARY OF THE INVENTION

It is a primary object of this invention to provide a radio in which the antenna may be readily replaced without risk of damage to internal radio components.

Another object of this invention is to provide a radio in which the antenna may be removed and replaced without disassembling the radio.

A further object is to provide a radio in which the antenna may be readily replaced by an untrained consumer.

A still further object of the invention is to provide for inexpensive replacement of a radio antenna by an untrained consumer.

Yet another object is to provide a radio in which the antenna may be replaced without the necessity of manually disconnecting and reconnecting the antenna and the radio receiver circuitry.

Briefly stated, in carrying out the invention in one form, a radio is provided with a replaceable antenna assembly including an elongated antenna having a base portion at one end thereof. The radio housing has first and second openings therein and an interior space between the two openings for receiving the base portion of the antenna. The first opening is sized to permit the base portion of the antenna to be selectively inserted into and retracted from the interior space from the exterior of the housing. The radio receiving circuitry includes an electrical connector, and means are provided for securing the electrical connector within the radio housing in a fixed position in which electrical contact occurs between the connector and the base portion of the antenna when the base portion is positioned within the interior space. The base portion of the antenna includes a first fastening means. The invention includes a second fastening means having a first portion engaging the exterior of the housing and a second portion extending through the second opening. The first portion includes operating means accessible from the exterior of the housing for selectively causing the second portion to either engage the first fastening means to lock the base portion within the interior space or disengage the first fastening means to release the base position. When the first fastening means is disengaged, the antenna may be removed and replaced through the first opening without requiring disassembly and reassembly of the housing.

By a further aspect of the invention, the housing has a slot formed therein, and the electrical connector comprises a conductive metal plate positioned within the slot and having angled projections thereon engaging a wall of the slot to prevent removal of the plate from the slot. In one form of the invention, the electrical connector is located between the base portion of the antenna and the second opening, the electrical connector having an opening through which the second portion of the second fastening means may pass. In another form of the invention, the electrical connector is located adjacent the base portion of the antenna, and the connector includes a resilient conductive wiper extending therefrom into contact with a side of the base portion.

In accordance with still further aspects of the invention, the radio housing includes means for guiding the base portion of the antenna into the interior space, and the first and second fastening means comprise complementary threaded fasteners. The first portion of the second fastening means comprises a head engageable by a suitable tool for rotating the second portion.

BRIEF DESCRIPTION OF THE DRAWINGS

While the novel features of the invention are set forth with particularity in the appended claims, the invention, both as to organization and content, will be better understood and appreciated, along with other objects and features thereof, from the following description taken in connection with the drawings, in which:

DESCRIPTION OF PREFERRED EMBODIMENTS

Figure 1:
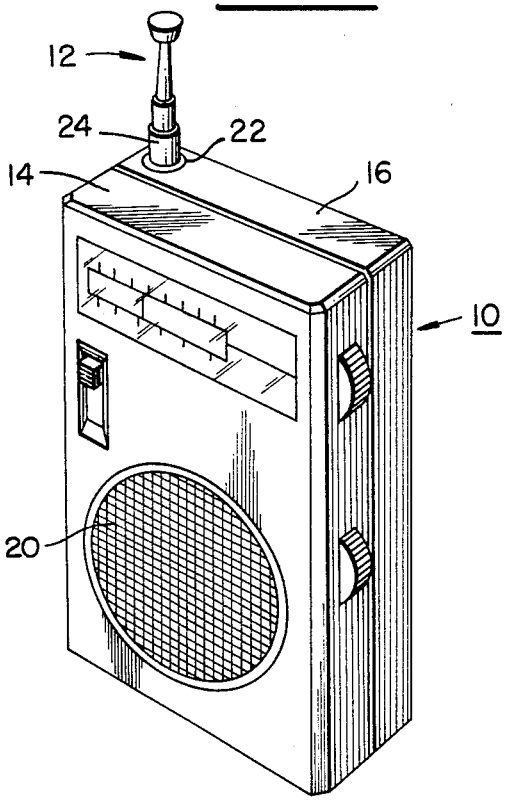
FIG. 1 is a perspective view of a portable pocket-size radio having a telescopic whip antenna secured within the radio housing in accordance with this invention.
Figure 2:
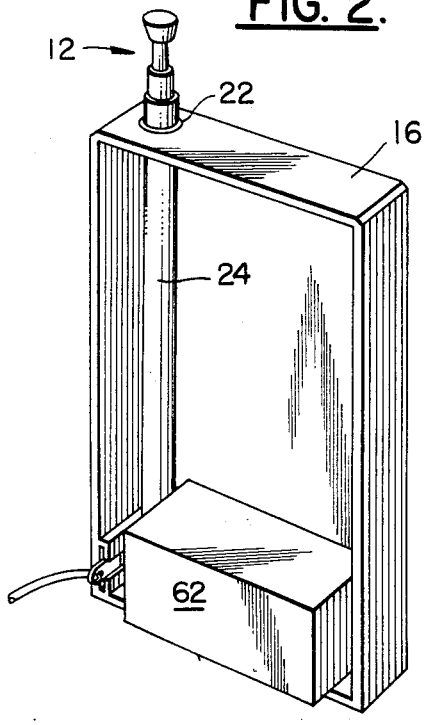
FIG. 2 is a view similar to FIG. 1 with the front half of the radio housing removed to illustrate the antenna in its secured position within the rear half of the housing.
Figure 3:
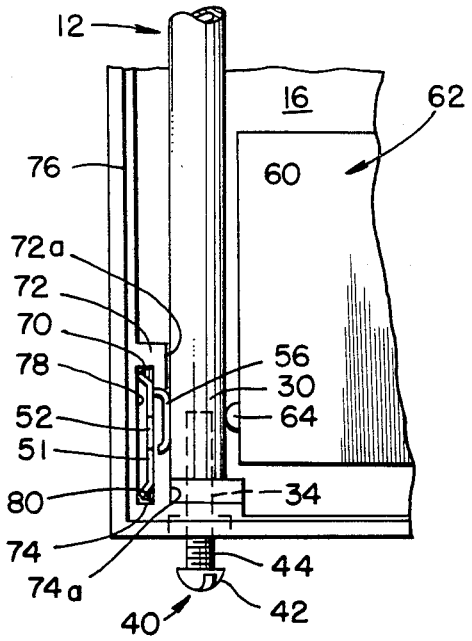
FIG. 3 is a front view of the lower left portion of the rear housing half as viewed in FIG. 2, this figure illustrating in detail the antenna and the electrical connector in their secured positions.

A portable pocket-size radio 10 is illustrated by FIG. 1, the radio having a telescopic whip antenna 12 which may be selectively extended by the user when FM reception is desired. The radio 10 includes front and rear housing halves 14 and 16, respectively, which enclose the radio receiving circuitry, speaker 20, and other operating components of the radio. The antenna 12 is secured in the rear half 16 of the housing and extends outwardly thereof through an opening 22 in the upper wall of the rear half 16 of the housing. The opening 22 just slightly larger in diameter than the outer shell 24 of the antenna 12 such that the antenna 12 will not wobble or vibrate within the housing during radio operation.

Figure 4:
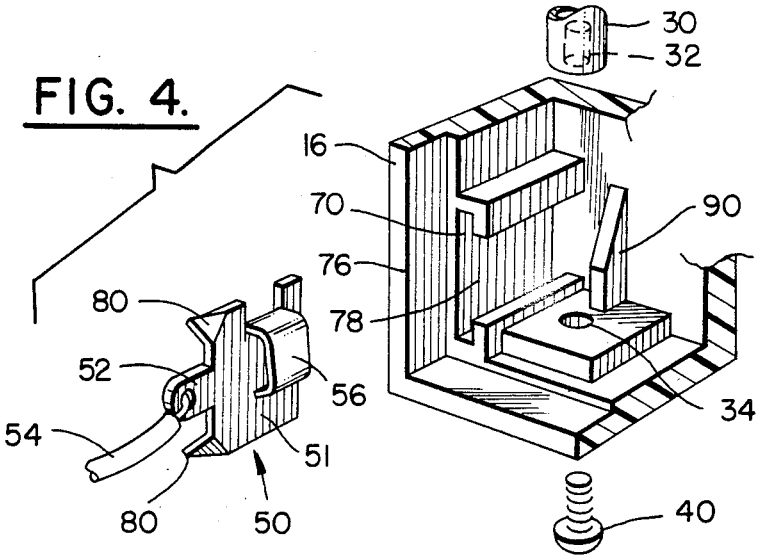
FIG. 4 is an exploded view of the components illustrated by FIG. 3.

Referring now to FIGS. 1–4, a first preferred embodiment of the invention will be described. The outer shell 24 of the antenna 12 is an elongated cylindrical member termininating at its lower end in a base portion 30, the base portion 30 having therein, as shown by FIG. 4, a threaded opening 32 coaxial with the antenna. The opening 22 in the upper wall of the rear half 16 of the housing is axially aligned with a second opening 34 extending through the bottom wall of the housing half 16. The antenna 12 in its assembled state extends axially through the interior space within the housing between the aligned openings 22 and 34 and, as described previously, extends through the opening 22 at its upper end. The lower opening 34 has a smaller diameter than that of the base portion 30 such that the lower end of the base portion 30 abuts the lower wall of the rear housing half 16 and the opening 34, but does not enter the opening 34.

The base portion 30 is secured in position by means of a screw 40 having a head 42 and a threaded shank portion 42. More particularly, the shank 44 extends through the opening 34 from the exterior of the radio housing 16 and is screwed into the threaded opening 32. By means of a screwdriver, the screw 40 is tightened to hold the antenna 12 securely at the base portion 30. The snug fit between the antenna 12 and the opening 22 holds the antenna 12 in a fixed position at the upper end thereof. When installed, the antenna 12 is thus securely held in position, and wobbling and vibration of the antenna 12 with the housing is substantially prevented.

An electrical connector 50 is permanently secured to the housing 16 adjacent the base portion 30. The electrical connector 50 comprises a conductive metal plate 51 connected by means of an integral tab 52 and a conductor 54 soldered thereto to the radio circuitry located elsewhere (not shown) within the radio 10. The connector 50 includes a resilient wiper 56 which extends from the plate portion 51 into contact with the side of the antenna base portion 30. The end wall 60 of a battery compartment 62 has a rib 64 formed thereon in alignment with the wiper 56, the spacing between the rib 64 and the wiper 56 in its unstressed state being somewhat less than the diameter of the base position 30. As a result, the wiper 56 is resiliently deflected to the left as viewed in FIG. 3 when the base portion 30 is located between the wiper 56 and the rib 64, thus assuring good electrical contact between the antenna 12 and the receiver circuitry.

The electrical connector 50 is secured within a slot 70. A pair of flanges 72 and 74 on the housing extend inwardly therefrom and terminate in mutually facing extension **72*a* and 74*a* to form the slot 70. The inner surface 78 of the side wall 76 intermediate the flanges 72 and 74 forms a back wall to the slot 70. The slot 70 is open between the flange extensions 72*a* and 74*a*. The metal plate 51 of the connector 50 is provided with projections 80 disposed at an angle of approximately forty-five degrees with respect to the plane of the plate 51. The angle of the projections on tabs 80 are selected such that the connector 50 may be readily moved from the position illustrated by FIG. 4 into the slot 70 to the position illustrated by FIG. 3. The length of the tabs 80 is selected such that the tabs force the plate 51 into firm engagement with the undersurfaces of the extensions 72*a* and 74*a*. Thereafter, the connector 50 may not be easily removed from the slot 70 because the tabs 80 are angled so as to dig into the housing wall 78 and resist movement out of the slot 70. In this manner, the electrical connector 50 is permanently installed in the slot 70 during initial assembly of the radio 10** at the factory.

If it should become necessary to replace the antenna 12, the procedure may be performed without disassembling the radio. In this respect, an untrained consumer may remove the antenna 12 by merely unscrewing the screw 40 and pulling the antenna 12 through the opening 22 in the upper wall of the housing half 16. When the antenna 12 is removed, the wiper 56 of the connector 50 merely slides along the base portion 30 of the antenna, the positioning of the connector 50 within the slot 70 being undisturbed. A new antenna 12 may be installed by inserting its base portion 30 through the opening 22 and pushing it downwardly until the base portion 30 abuts the bottom wall of the housing half 16 and resilient contact has been again established between the wiper 56 and the base portion 30. The housing may be provided with appropriate guide members or surfaces, one of which is identified by the numeral 90, to guide the lower end of the base portion 30 and the threaded opening 32 therein into exact alignment with the opening 34 in the lower wall of the housing half 16. These guide members may include members, not shown, extending rearwardly from the front housing half 14. Whether or not guide members are used, it is necessary that the component layout within the housing be selected such that the antenna 12 cannot come into contact with delicate radio components during the removal and replacement motions. The replacement process is completed by merely reconnecting the screw 40 to lock the base portion 30 of the new antenna 12 in position.

Figure 6:
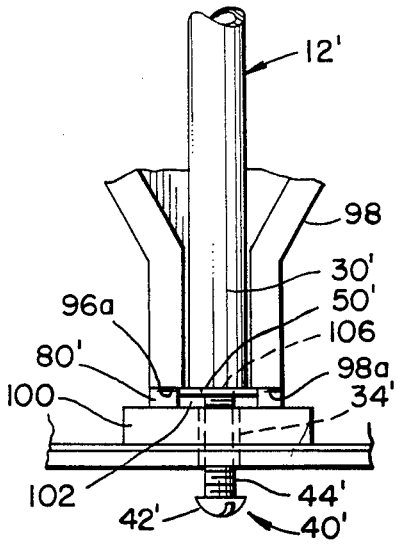
FIG. 6 is a front view of the components illustrated by FIG. 5.
Figure 5:
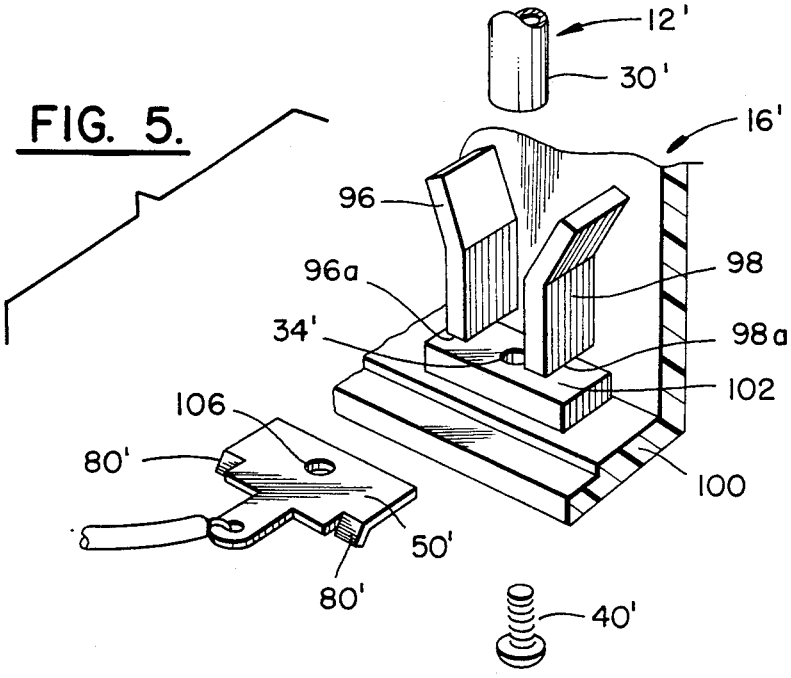
FIG. 5 is a view similar to FIG. 4 showing a modified form of the invention.

A second embodiment of the invention is illustrated by FIG. 5 and 6. The components of this embodiment are for the most part substantially identical to those of the first embodiment and are therefore identified by primed numerals and will not be described in detail. In this embodiment, a pair of guide walls 96 and 98 are provided on opposite sides of the antenna 12. As illustrated, the guide surfaces 96 and 98 are adjacent only the antenna base position 30, but if space within the radio permits, the walls 96 and 98 may extend substantially the entire length of the interior space between the openings in the top and bottom walls of the housing half 16.

The walls 96 and 98 terminate at lower ends 96*a* and 98*a*, respectively, spaced slightly above the lower wall 100 of the housing half 16 to form a slot 102 therebetween. An electrical connector 50' is disposed within the slot 102, its angled tabs 80' engaging the upper surface of the lower wall 100 to hold the connector 50' in position. Instead of a wiper, the connector 50' has a central opening 106 therein that is axially aligned with the opening 34' and the opening in the upper wall when the connector 50' is assembled in the slot 102. The base portion 30' is secured in position by means of a screw 40' which extends through the openings 34' and 106 into the threaded opening in the end of the base portion 30'. Electric coupling to the radio circuitry is provided by the positive contact between the base portion 30' and the connector 50' when the screw 40' is tightened.

As in the case of the embodiment illustrated by FIGS. 1–4, the antenna 12' of the embodiment of FIGS. 5 and 6 may be removed by removing the screw 40' and pulling the antenna outwardly through the opening in the upper wall of the housing. A new antenna 12' may be inserted by shoving it downwardly through the opening in the upper wall until its base portion 30 abuts the connector 50'. The screw 40' may then be reinstalled.

From the foregoing, it will be seen that the present invention provides a radio in which the antenna may be replaced easily without disassembling the radio and risking damage to internal radio components. The replacement procedure of this invention may be performed by by an inexperienced and untrained consumer at minimal cost.

While the invention has been particularly shown and described with reference to preferred embodiments thereof, it will be understood by those skilled in the art that various changes in form, details, and application may be made therein without departing from the spirit and scope of the invention. Accordingly, it is intended that all such modifications and changes be included within the scope of the appended claims.

What is claimed as new and is desired to secure by Letters Patent of the United States is:

1. In a radio product, a replaceable antenna assembly comprising:

an elongated antenna having a base portion at one end thereof, said base portion including first fastening means, a housing defining first and second openings therein an interior space extending therebetween for receiving at least said base portion of said antenna, said first opening sized to permit said base portion of said antenna to be selectively inserted into and retracted from said interior space from the exterior of said housing, receiver circuit means including an electrical connector, said housing including means forming a slot therein and said electrical connector comprising a conductive metal plate positioned within said slot, said electrical connector having angled projections thereon engaging a wall of said slot to prevent removal of said plate from said slot thereby securing said electrical connector within said housing in a fixed position in which electrical contact is provided between said connector and said base portion of said antenna when said base portion is positioned within said interior space, and second fastening-means including a first portion for engaging the exterior of said housing and a second portion for extending through said second opening, said first portion including operating means accessible from the exterior of said housing for selectively causing said second portion to either engage said first fastening means to lock said base portion within said interior space or disengage said first fastening means to release said base portion, whereby said antenna may be removed and replaced without requiring disassembly and reassembly of said housing.

2. A replaceable antenna assembly as defined by claim 1 in which said electrical connector is located intermediate said base portion of said antenna and said second opening, said electrical connector having an opening therein for passage therethrough of said second portion of said second fastening means.

3. A replaceable antenna assembly as defined by claim 1 in which said electrical connector is located adjacent said base portion of said antenna, said electrical connector including a resilient conductive wiper extending therefrom into contact with a side of said base portion.

4. A replaceable antenna assembly as defined by claim 1 in which said housing further includes means for guiding said base portion into said interior space.

5. A replaceable antenna assembly as defined by claim 1 in which said first fastening means comprises a threaded opening in the end of said base portion of said antenna, said threaded opening being coaxial with the axis of said antenna, and said second fastening means comprises a threaded fastener in which said second portion is a threaded shank for selectively engaging said threaded opening and said first portion comprises a head engageable by a suitable tool for rotating said threaded shank.

6. A replaceable antenna assembly as defined by claim 5 in which said electrical connector is located intermediate said base portion of said antenna and said second opening, said electrical connector having an opening therein for passage therethrough of said second portion of said second fastening means.

7. A replaceable antenna assembly as defined by claim 5 in which said electrical connector is located adjacent said base portion of said antenna, said electrical connector including a resilient conductive wiper extending therefrom into contact with a side of said base portion.

8. A replaceable antenna assembly as defined by claim 1 in which said housing further includes means for guiding said base portion into said interior space.

9. A replaceable antenna assembly as defined by claim 8 in which said electrical connector is located intermediate said base portion of said antenna and said second opening, said electrical connector having an opening therein for passage therethrough of said second portion of said second fastening means.

10. A replaceable antenna assembly as defined by claim 8 in which said electrical connector is located adjacent said base portion of said antenna, said electrical connector including a resilient conductive wiper extending therefrom into contact with a side of said base portion.

* * * * *